US006481411B1

(12) United States Patent
Katayama

(10) Patent No.: US 6,481,411 B1
(45) Date of Patent: Nov. 19, 2002

(54) IDLE SPEED CONTROL FOR FUEL INJECTION OUTBOARD MOTOR

(75) Inventor: Goichi Katayama, Shizuoka (JP)

(73) Assignee: Sanshin Kogyo Kabushiki Kaisha (JP)

( * ) Notice: Subject to any disclaimer, the term of this patent is extended or adjusted under 35 U.S.C. 154(b) by 0 days.

(21) Appl. No.: 09/470,245

(22) Filed: Dec. 22, 1999

(30) Foreign Application Priority Data

Dec. 22, 1998 (JP) ..... 10-365674

(51) Int. Cl.[7] ..... F02M 33/04
(52) U.S. Cl. ..... 123/339.23; 123/518; 123/520
(58) Field of Search ..... 123/516, 517, 123/518, 519, 520, 339.23–339.27

(56) References Cited

U.S. PATENT DOCUMENTS 4,276,862 A 7/1981 Matsumoto
4,323,041 A 4/1982 Endo et al.
4,395,991 A 8/1983 Miyachi et al.
4,550,700 A 11/1985 Yoshida et al.
4,649,876 A 3/1987 Ohmi et al.
4,660,530 A 4/1987 Sugiyama et al.
4,702,203 A 10/1987 Ohmi et al.
4,726,337 A 2/1988 Yoshida
4,726,340 A 2/1988 Hasegawa et al.
4,727,829 A 3/1988 Kondo et al.
4,763,612 A 8/1988 Iwanami
4,765,285 A 8/1988 Kobayashi
4,766,853 A 8/1988 Iwanami
5,000,130 A 3/1991 Yamada
5,005,536 A 4/1991 Suzuki et al.
5,092,287 A 3/1992 Motoyama et al.
5,216,991 A * 6/1993 Iida et al. ..... 123/339.23
5,450,831 A 9/1995 Fukuoka
5,551,394 A 9/1996 Yoshikawa
5,727,522 A * 3/1998 Otani et al. ..... 123/339.11
5,791,314 A 8/1998 Ito
5,797,378 A 8/1998 Kato
5,819,711 A 10/1998 Motose
5,829,402 A 11/1998 Takahashi et al.
5,924,409 A 7/1999 Kato
6,098,591 A * 8/2000 Iwata ..... 123/339.11
6,105,556 A * 8/2000 Takaku et al. ..... 123/520
6,158,415 A * 12/2000 Ichikawa et al. ..... 123/339.23

* cited by examiner

*Primary Examiner*—Erick Solis
(74) *Attorney, Agent, or Firm*—Knobbe, Marten, Olson & Bear, LLP

(57) ABSTRACT

An outboard motor has an idle speed control in an induction and fuel injection system. The idle speed control controls the rate of flow of air through a bypass passage into the induction system to help improve engine performance. The bypass passage bypasses flow through the throttle body to increase the air flow while the throttle body is either closed or in a wide open position. Of course, the arrangement also can be used to increase the air flow in other orientations of the throttle valve. The bypass passage also is connected to a vent from a vapor separation tank such that vapor from the gas-filled vapor separation tank passes into the bypass air flow and is admitted into the intake system downstream of the throttle valve. The bypass air flow is subdivided between a number of the intake pipes. The bypass arrangement thus advantageously introduces a subdivided amount of ventilation air from the vapor separation tank into each of the plurality of combustion chambers formed within the engine. Thus, the arrangement substantially equalizes the amount of vent air being introduced into each combustion chamber through the bypass arrangement.

36 Claims, 10 Drawing Sheets

IDLE SPEED CONTROL FOR FUEL INJECTION OUTBOARD MOTOR

PRIORITY INFORMATION

This application is based on and claims priority to Japanese Patent Application No. Hei 10-365,674, filed Dec. 22, 1998, the entire contents of which is hereby expressly incorporated by reference.

BACKGROUND OF THE INVENTION

1. Field of the Invention

The present invention generally relates to fuel-injected outboard motors. More particularly, the present invention relates to a fuel system venting arrangement for such outboard motors.

2. Description of the Related Art

Outboard motors are used to power marine vehicles. The outboard motors typically include an engine positioned within a protective cowling of the outboard motor. The outboard motor is attached to the back of the watercraft and used to propel the watercraft in a forward or reverse direction. The outboard motors include induction systems and fuel supply systems to provide an air/fuel charge into the combustion chambers for combustion in order to provide a rotary motion to an output shaft that drives the propeller.

In the engines of the outboard motors, fuel is often supplied to a vapor separator upstream of a fuel injector. The vapor separator is used to remove vapors from the fuel prior to the fuel being pumped into a fuel rail associated with the fuel injectors by a high pressure fuel pump. This separation reduces entrainment of gases and vapors within the fuel supply, which can cause problems with the fuel injection system. Separated fuel vapor and air typically is discharged from the vapor separator through a discharge duct into the induction system for combustion with the air/fuel charge. Typically, the vent air and fuel vapor that is discharged from the vapor separator tank is delivered through an intake pipe together with air flowing from a plenum chamber.

The vent air or fuel vapor that is discharged from the vapor separator generally comprises a portion of evaporated gasoline and therefore is flammable. As more vent air flows into a single combustion chamber, the output power of the associated cylinder increases because of the overly rich air fuel mixture. Conversely, as the level of this vent vapor decreases in a single cylinder, the power of that cylinder decreases due to a lean mixture.

As is known, the plenum chamber generally contains a large volume of air. The vent air coming into this large volume of air from the vapor separator generally is not equally mixed with the air. Under such conditions, the proportion of vent vapor to intake air delivered to each individual cylinder from the plenum chamber fluctuates. The fluctuation in proportion from cylinder to cylinder causes unstable engine performance and reduces engine power. In particular, in multiple cylinder engines, the inconsistent vent air proportion delivered to each combustion chamber creates a disparity in output power between cylinders.

SUMMARY OF THE INVENTION

Accordingly, it is desired to have a fuel supply system and induction system that can supply a substantially equal and subdivided portion of the vent vapor to each of the cylinders for combustion. Such an arrangement would lead to more stable engine operation and better overall power output from the engines. In addition, the vent vapor supply should be controllable to increase available power under certain running conditions.

Accordingly, one aspect of the present invention involves an engine comprises a plurality of cylinders that include corresponding combustion chambers. The engine further comprises an induction system and a fuel supply system that are in fluid communication with the combustion chambers. The induction system comprises an intake chamber and a plurality of intake conduits that correspond to the combustion chambers. Each intake conduit is in fluid communication with the intake chamber and the corresponding combustion chamber. A throttle device is positioned between at least one of the intake conduits and the intake chamber to regulate a flow of air into at least one of the combustion chambers. A bypass passage extends from the intake chamber and a portion of the induction system downstream of the throttle device. A flow control member is positioned along the bypass passage to selectively regulate flow through the bypass passage.

In a preferred mode, the fuel supply system comprises a fuel supply. A supply conduit connects the fuel supply to a vapor separation tank. At least one pump is positioned along the supply conduit with a plurality of fuel injectors that are in fluid communication with the vapor separation tank. A vent passage extends between the vapor separation tank and a portion of the bypass passage positioned upstream of the flow control member.

The engine has particular utility in the context of an outboard motor. Thus, in accordance with a further aspect of the present invention, the engine can be provided in an outboard motor with its output shaft arranged in an vertical orientation. A drive shaft of the outboard motor is operatively connected to the output shaft. A transmission selectively couples the drive shaft to a propulsion device of the outboard motor. In this manner, the engine powers the propulsion device which can be driven in multiple operating states by the transmission (e.g., forward or reverse).

Another aspect of the present invention involves a method of controlling flow through a bypass of an induction system. The method comprises sensing an engine operating condition, determining a desired level of bypass flow volume by comparing the engine operating condition to a map of values, and adjusting the bypass flow volume according to a value selected from the map of values by manipulating an bypass flow control member.

Further aspects, features and advantages of the present invention will also become apparent from the detail description of the preferred embodiments that follows.

BRIEF DESCRIPTION OF THE DRAWINGS

The present invention will now be described with reference to the drawings of two preferred embodiments, which embodiments are intended to illustrate but not to limit the present invention and in which figures.

DETAILED DESCRIPTION OF THE PREFERRED EMBODIMENTS OF THE PRESENT INVENTION

Figure 1:
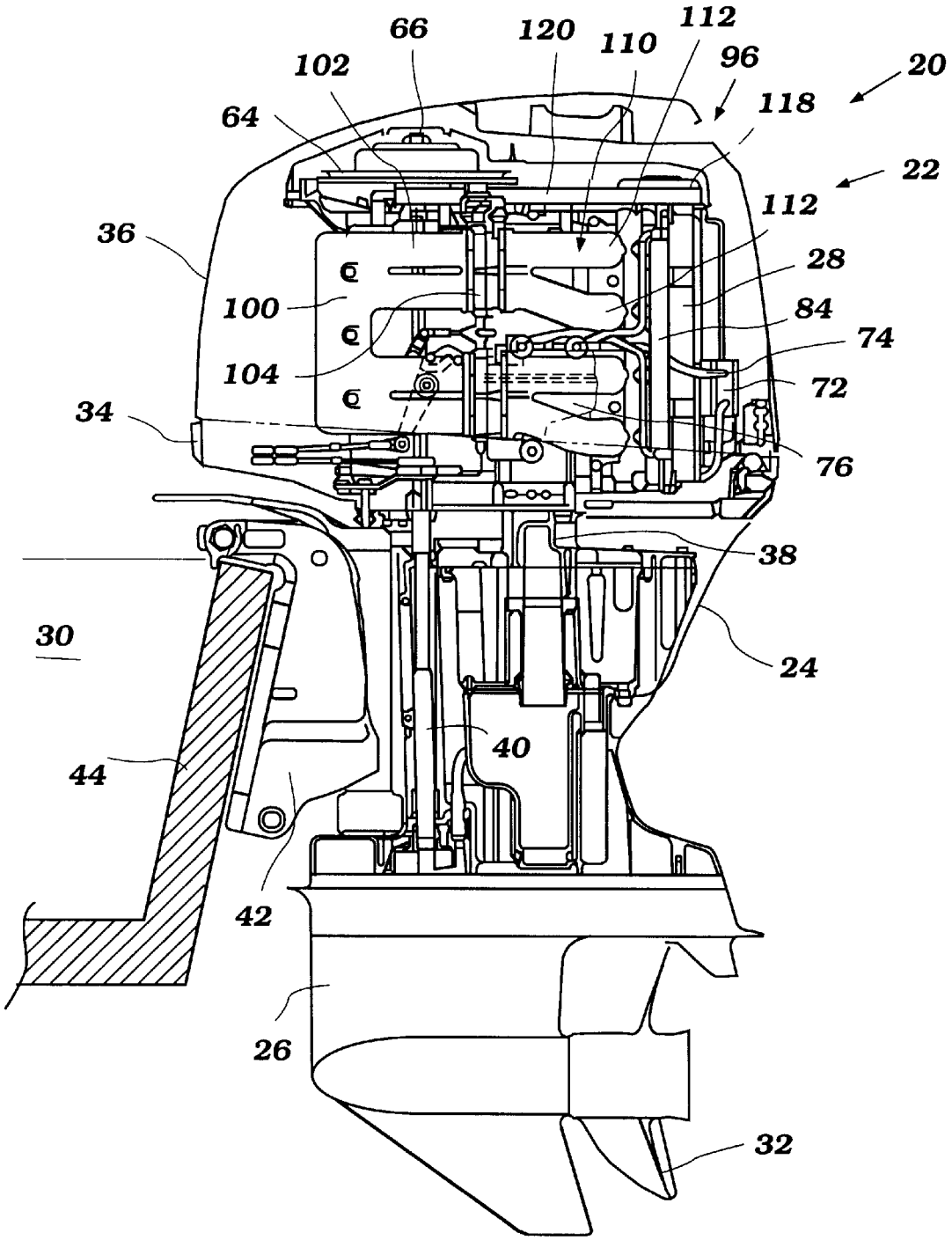
FIG. 1 is a partially sectioned side elevational view of an outboard motor having an engine and fuel supply system arranged and configured in accordance with certain features, aspects and advantages of the present invention.

With reference initially to FIG. 1, an outboard motor, indicated generally by the reference numeral 20, is illustrated therein. The illustrated outboard motor 10 advantageously incorporates a fuel system and induction system configured and arranged in accordance with certain features, aspects and advantages of the present invention. The configuration results in improved engine performance during various operating conditions of the engine. Although the present invention is described in conjunction with the illustrated outboard motor, it should be understood that certain features, aspects and advantages of the present invention can also be used in other applications such as, for example, but without limitation, other marine drive applications (e.g., an inboard motor and an inboard/outboard drive) and in a variety of other land-based vehicles and engine applications.

The illustrated outboard motor 10 generally comprises a powerhead 22, a driveshaft housing 24, and a lower unit 26. The powerhead 22 preferably includes an internal combustion engine 28 that is used to power a watercraft 30 to which the outboard motor is mounted. The mid section or driveshaft housing 24 extends downward below the powerhead 22 and contains portions of an exhaust system associated with the engine 28 as well as a driveshaft as will be described. The lower unit 26 typically includes a transmission and journals a propulsion shaft that drives a propeller 32.

The powerhead 22 generally includes a protective cowling which surrounds the engine 28. The cowling generally comprises both a lower tray portion 34 and an upper main cover portion 36. Typically, the main cover portion 36 is hingedly connected to the lower tray portion 34, or otherwise removably affixed to the lower tray portion 34, such that the engine 28 may be accessed by removing the main cover portion 36 from the lower tray portion 34. In addition, the joint between the lower tray portion 34 and the main cover portion 36 preferably is provided with a seal or other type of water tight connection such that water infiltration can be reduced or minimized. Such a construction results in improved protection of the engine 28 from ingestation of water during operation.

With continued reference to FIG. 1, the mid section 24 contains an exhaust guide plate 38 to which the engine is typically mounted in a conventional manner. Thus, the engine 28 is connected to the balance of the outboard motor 20 in the illustrated embodiment through the use of the exhaust guide plate 38. In addition, the exhaust guide plate 38 forms a portion of the exhaust system which will be described in greater detail below.

As mentioned above, the lower unit 26 preferably includes a transmission to transfer power from a driveshaft 40 to the impeller or propeller 32. Preferably, the transmission is a forward/neutral/reverse type transmission. This type of transmission enables the watercraft to be driven in any of these operational states. The transmission selectively establishes a driving condition of the propeller 32. Of course, as will be recognized by those of ordinary skill in the art, the propeller 32 can be replaced by any other known or suitable propulsion device. For instance, but without limitation, the propulsion device 32 could be jet pump unit.

As is generally known to those of ordinary skill in the art, the present outboard motor 10 can be attached to the watercraft 30 using a clamp and swivel bracket 42. As illustrated, the clamp and swivel bracket 42 is configured to attach the outboard motor 10 to the watercraft 30 along a transom or rear wall 44. The bracket 42 enables the motor 20 to be both steered about a generally vertical axis and tilted or trimmed about a generally horizontal axis. As the bracket 42 forms no part of the present invention per se, further description thereof is unnecessary.

Figure 2:
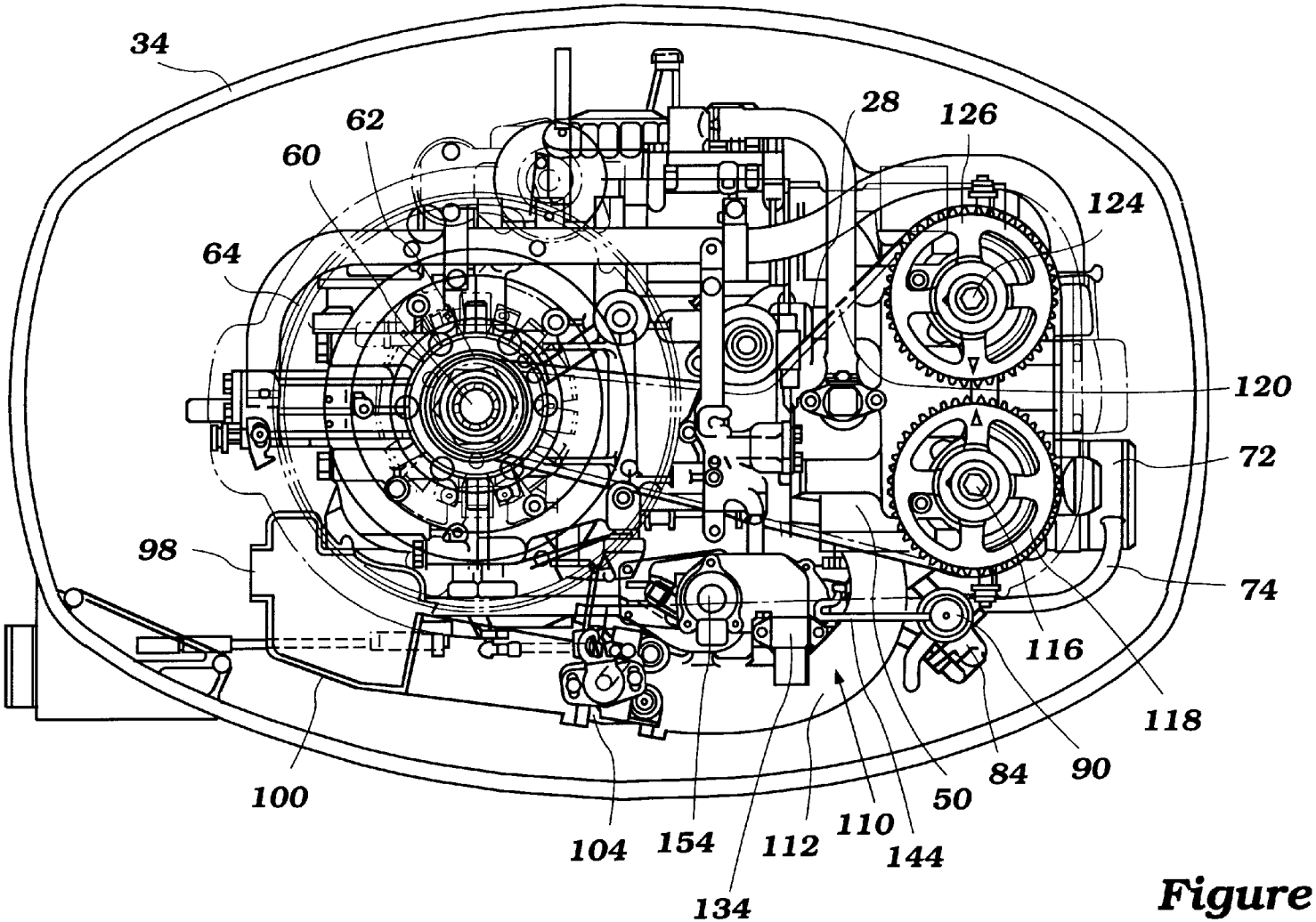
FIG. 2 is a top plan wire frame view of the outboard motor of FIG. 1.

With reference now to FIG. 2, the illustrated engine 28 is preferably of the inline type. More preferably, the engine 28 is of the four-cylinder, four-cycle type. In some arrangements, the engine can have greater or lesser numbers of cylinders and can be arranged to have a pair of banks having a generally V configuration. Of course, other cylinder block configurations and cylinder arrangements can also benefit from certain features, aspects and advantages of the present invention.

Figure 3:
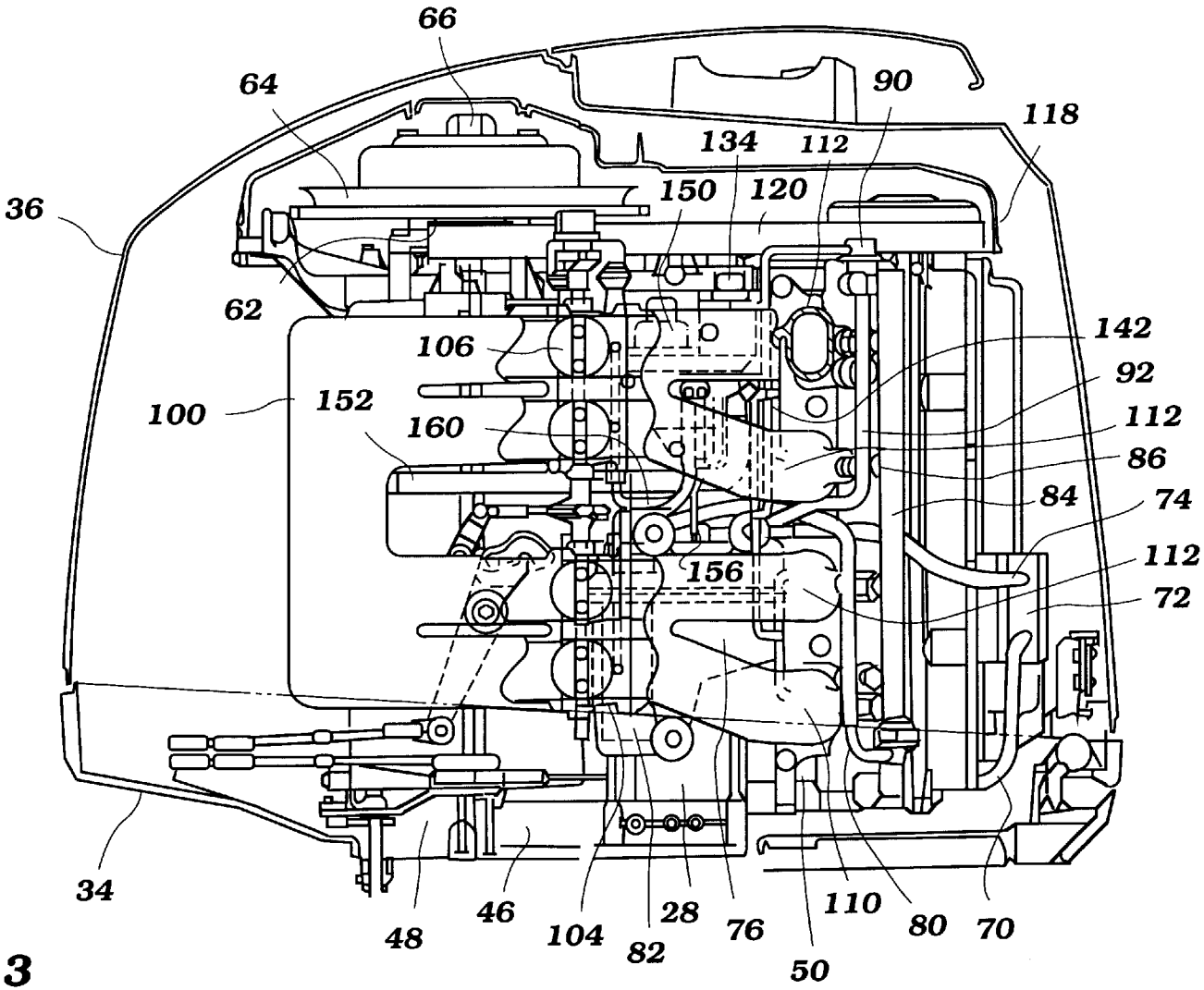
FIG. 3 is a partial side elevation wire frame view of the engine of the outboard motor of FIG. 1.
Figure 4:
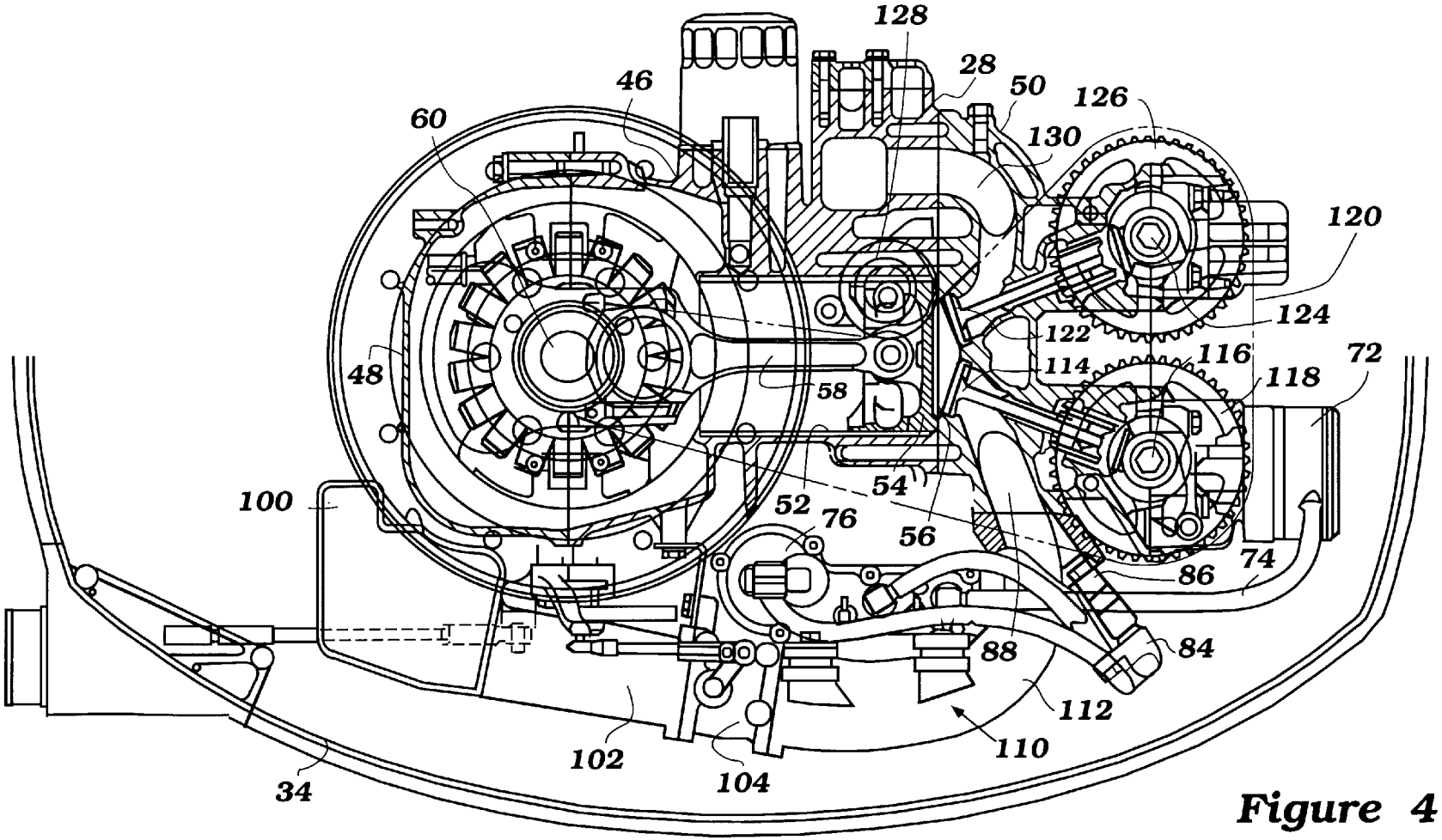
FIG. 4 is a partial top plan wire frame view of the engine of the outboard motor of FIG. 1.

With reference now to FIGS. 3 and 4, the engine 28 generally comprises a cylinder block 46, a crankcase 48, and a cylinder head 50. As is generally known, the cylinder block 46 is interposed between the cylinder head 50 and the crankcase 48. The crankcase, as used herein, generally refers to the crankcase member forming the crankcase chamber.

With continued reference to FIG. 4, the cylinder block 46 contains a number of bores that define cylinders 52. The cylinders 52 may be formed directly in the cylinder block 46 and may include a sleeve or a plated surface. As described above, the engine 28 desirably includes four inline cylinders 52; however, other configurations are also possible.

A set of pistons 54 are positioned in corresponding cylinders 52. The pistons reciprocate within the cylinders as a result of combustion occurring in a combustion chamber 56. With continued reference to FIG. 4, a combustion chamber 56 is defined by recesses formed within the cylinder head 50 and by the cylinder wall 52 and the head of the piston 54.

Each of the pistons 54 is connected to a first end of a connecting rod 58 by pins in a known manner. The connecting rod 58 also includes a large end that is attached to a portion of a crankshaft 60. More specifically, the connecting rod 58 is rotatably connected to a throw of the crankshaft 60. Thus, reciprocal movement of the piston 54 within the cylinder 52 causes rotational movement of the crankshaft 60, which is journaled in a suitable manner in a crankcase chamber.

The crankshaft 60 generally is positioned in a substantially vertical orientation, such that the crankshaft 60 rotates about a generally vertical axis. This orientation facilitates coupling of the crankshaft 60 to the driveshaft 40. In addition, this orientation helps maintain a compact arrangement for the outboard motor 20.

With reference again to FIGS. 1 and 3, a drive pulley 62 and a flywheel 64 preferably are connected to an upper end of the illustrated crankshaft 60. As illustrated in FIG. 1, the flywheel 64 is held in position on the crankshaft 60 through the use of a nut 66. Of course, other suitable mounting arrangements can also be used. In addition, the flywheel 64 and the drive pulley 62 can be positioned at other points along the crankshaft and driveshaft combination. However, the illustrated arrangement results in a fairly compact structure of the outboard motor 20. As is generally known, the flywheel 64 may include a starter ring that is selectively engaged by a starter motor during starting of the engine 28 of the outboard motor 20.

Figure 5:
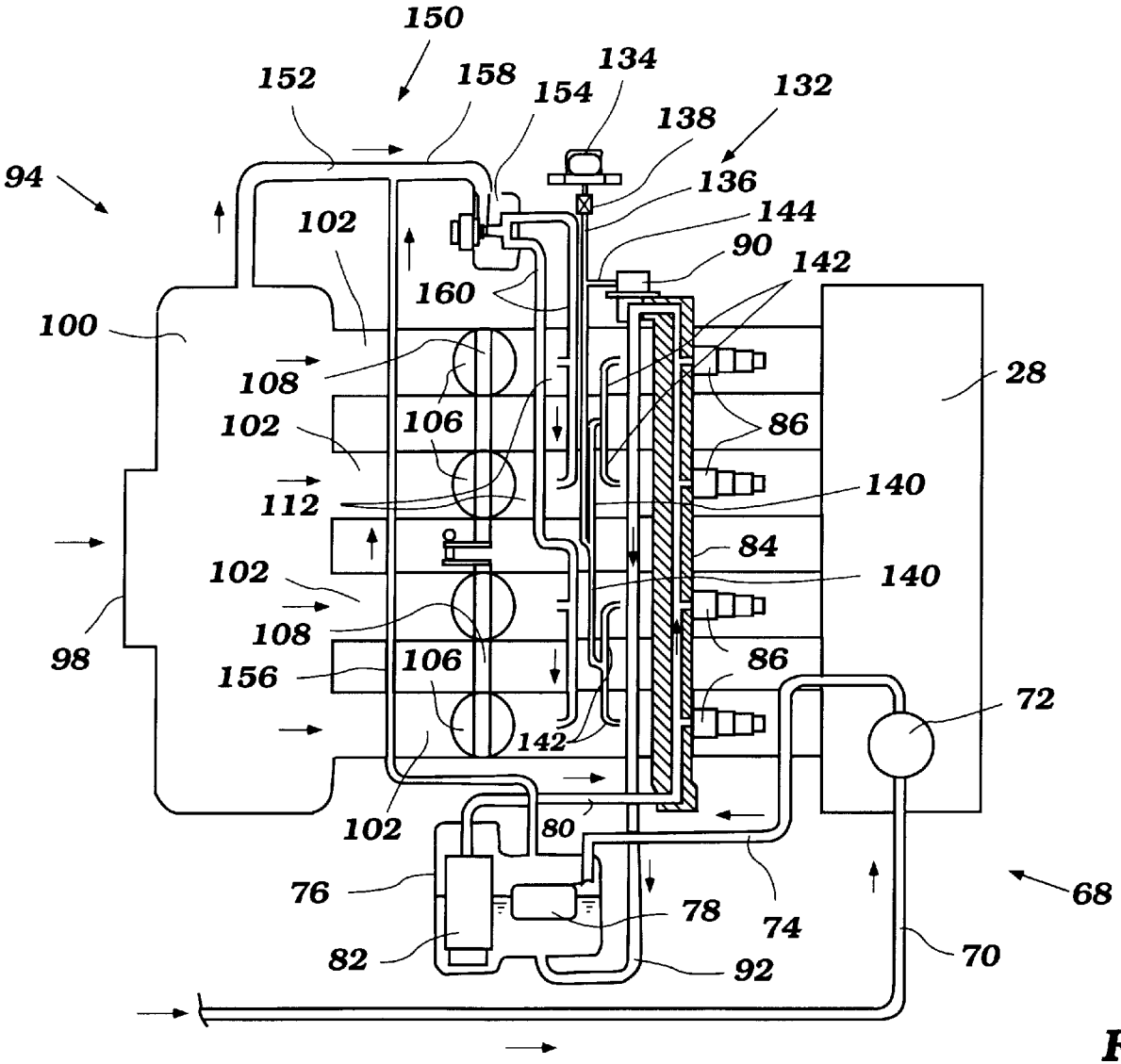
FIG. 5 is a schematic illustration of a fuel supply system and an air induction system of the engine of the outboard motor of FIG. 1.

With reference now to FIG. 5, the outboard motor 20 preferably includes a fuel supply system 68. The fuel supply system provides a charge of fuel for combustion within the combustion chambers 56. As illustrated, fuel is drawn from an onboard fuel tank (i.e., the fuel tank is positioned in the hull of the watercraft 30) through a first delivery line 70. The fuel can be pumped into the fuel delivery line 70 from the fuel tank by a first low pressure fuel pump (not shown). Of course, other pumping arrangements can also be used.

The fuel also is pumped by a second low pressure fuel pump 72 in the illustrated engine 28. The low pressure fuel pump 72 preferably is a diaphragm-type pump that is operated by pressure variations within the crankcase 48. Accordingly, the fuel pump 72 operates at a fairly low pressure.

The low pressure fuel pump delivers fuel through a second delivery line 74 to a vapor separation tank 76. The flow of fuel through the second delivery line 74 preferably is controlled by a float valve 78. The float valve 78 includes a float that rises and falls with the level of fuel within the vapor separation tank 76. As the level of fuel rises, the float also rises, thereby closing the valve 78 and stopping the flow of fuel through the delivery line 74. As the level of fuel falls within the vapor separation tank 76, the float is lowered, thereby opening the valve 78 and allowing fuel to flow through the delivery line 74. Preferably, the vapor separation tank 76 is located at about the same level as the fuel pump to decrease the effects of gravity on the head of fuel being supplied by the fuel pump 72.

With continued reference to FIG. 5, the fuel is provided from the vapor separation tank 76 to a discharge pipe 80. More specifically, a high pressure fuel pump 82 that is preferably positioned within the vapor separation tank 76 pumps fuel through the discharge pipe 80 under a high pressure. The discharge pipe 80 is in registry with a fuel rail 84. The fuel rail 84 extends in a generally vertical direction and supplies fuel to each of a plurality of fuel injectors 86.

With reference now to FIG. 4, the fuel injector 86 preferably is mounted to the cylinder head 50 along an intake passage 88 formed in the cylinder head 50. The intake passage 88 will be described in greater detail below. The pressure within the fuel rail 84, and therefore the fuel injectors 86, is controlled by a pressure regulator 90. The pressure regulator 90 operates in any suitable manner to control the pressure building within the fuel rail 84. In the illustrated embodiment, the pressure regulator 90 returns a portion of the fuel passing through the fuel rail 84 back to the vapor separation tank 76 through a return line 92.

With reference to FIG. 5, the return line 92 empties into a lower portion of the vapor separation tank 76 and therefore operates against the head of fuel contained in the vapor separation tank 76. Of course, other arrangements can also be used.

With reference again to FIG. 5, the outboard motor 20 also includes an induction system 94. The induction system 94 supplies air to the combustion chambers 56 for combustion along with the charger fuel provided by the fuel supply system 58.

With reference now to FIG. 1, the outboard motor 20 has a vent 96 formed in the main cowling portion 36 of the powerhead 22. The vent admits air from a rearwardly facing portion of the outboard motor 20 into an engine compartment defined within the powerhead 22. The air flows through the vent and into the engine compartment and is drawn into the induction system 94 through an air inlet 98. The air inlet 98 is formed on a forwardly facing portion of a plenum chamber 100. The plenum chamber provides a large volume of air from which a plurality of individual air intake pipes 102 can draw air. In some arrangements, the plenum chamber is used to tune the induction system as is generally known.

With reference again to FIG. 1, a plurality of throttle valve body 104 are placed in communication with the plenum chamber 100 by the illustrated intake pipes 102. In the illustrated arrangement, there are four intake pipes and four corresponding throttle valve bodies 104. As is generally known, throttle valve bodies 104 include valves 106 that rotate on a valve shaft 108. In the illustrated arrangement, two valves 106 are mounted on each valve shaft 108 such that there are two valve shafts 108 associated with the induction system 94. The valves open and close the air flow path through the intake pipes 102 and more specifically through the throttle valve bodies 104 to control the amount of air being inducted into the engine 28. The valves may be actuated using any suitable actuation mechanism such that the flow of air can be controlled by an operator according to the speed at which the operator desires the engine 28 to be run.

Downstream of the throttle valve bodies 104 are located induction manifolds 110. In the illustrated arrangement, two induction manifolds 110 are provided and each corresponds to two of the intake pipes 102 and throttle valve bodies 104. The induction manifold 110 includes separate runners 112 that place a throttle valve body 104 in communication with the intake passage 88 of the corresponding cylinder 52. As described above, fuel injectors 86 inject a charge of fuel into the inducted air supply just prior to entry into the intake passages 88 formed within the cylinder head. It is also anticipated, however, that the fuel injectors 86 could be positioned in other locations to properly inject fuel into the air supply prior to combustion within the engine.

The induction of air through the air intake passages 102, 104, 112, 88 desirably is controlled by an intake valve 114. The intake valve 114 closes an intake port in a known manner. It is operated through the use of an intake cam arrangement as is generally known to those of skill in the art. The intake cam arrangement includes an intake cam shaft 116 that carries an intake cam pulley 118. The intake cam pulley 118 is driven by a timing belt 120 that loops around the drive pulley 62 attached to the crankshaft 60. Preferably, the cam pulley 118 is as twice the diameter of the drive pulley 62 such that for each revolution of the crankshaft 60, the cam shaft 116 only returns half of a revolution.

Following combustion within the combustion chamber 56, exhaust gases are removed from the combustion chamber 56 through an exhaust port. The exhaust port is selectively opened and closed by the use of an exhaust control valve 122. The exhaust control valve is similarly controlled by a cam arrangement such as that described above in the context of the intake valve 114. Specifically, an exhaust cam shaft 124 selectively opens and closes the exhaust control valve 122 in a known manner. The exhaust cam shaft 124 carries a pulley 126 that is also driven by the timing belt 120. As illustrated, the timing belt 120 can be tensioned using a tension pulley or idler pulley 128. Also, as discussed above, the pulley 126 preferably has twice the diameter of the drive pulley 62 such that two revolutions of the crankshaft 60 are required to cause a single revolution of the cam pulley 126.

As exhaust passes through the exhaust port when the exhaust control valve 122 is opened, the gas is passed through an exhaust passage 130 formed within the cylinder head 50. The exhaust gases are then passed from the engine and out to the environment through any suitable exhaust system that is connected to the engine, as is generally known to those of ordinary skill in the art. For instance, the exhaust gases may pass through an exhaust manifold, into an exhaust guide plate, through the exhaust guide plate, and into the body of water through the hub of the propeller 32. Of course, other arrangements can also be used.

The outboard motor 20 also features an induction air pressure detection system 132. The system 132 features an induction air pressure sensor 134. The sensor 134 preferably is positioned proximate the runners 112 of the induction manifold 110. More preferably, the sensor 134 is in simultaneous registry with each of the runners 112. Of course, the sensor 134 could be arranged to be a simultaneous registry with fewer than all of the runners in some applications.

A pipe 136 is connected to the sensor 134 through a filter 138. The pipe 136 is sized to allow pressure variations at one end of the pipe 136 to be detected at the other end of the pipe, which is connected to the sensor 134.

With reference to FIG. 5, the pipe 136 is connected to a pair of branch pipes 140 in the illustrated arrangement. Preferably, the juncture between the pair of branch pipes 140 and the pipe 136 is centrally positioned among the two central cylinders of the cylinder bank.

The branch pipes 140, in turn, extend from the juncture with the pipe 136 to a set of tertiary pipes 142. Preferably, the junctures between the branch pipes 140 and the tertiary pipes 142 are centralized between a pair of adjoining cylinders. Thus, the tertiary pipes 142 are substantially the same length from the juncture with the branch pipe 140 to the end disposed within the intake manifold or runner 112. Preferably, the overall combined length of the tertiary pipes 142, the branch pipes 140 and the pipe 136 is substantially the same. In other words, the combined length of piping from the sensor 134 to the end of each tertiary pipe 142, which is positioned within the intake runner 112, is substantially the same for each cylinder.

The pipe 136, branch pipes 140 and tertiary pipes 142 together function as a balance passage and connect the runners 112 to one another so as to generally balance the pressure from runner 112 to runner 112. The balance passage also communicates with the fuel pressure regulator 90 to improve control of the fuel injection system. The preferred embodiment illustrates the pipes 136, 140, 142 as external components; however, at least portions of these passages can be internally formed within the intake manifolds.

A connecting duct 144 extends from an upper portion of the illustrated pipe 136 to the fuel pressure regulator 90. Thus, the fuel pressure can be more closely tied to the pressure of air in any individual intake passage at the time of injection into that intake passage or associated cylinder.

The illustrated outboard motor 20 also includes an idle speed control system 150. The idle speed control system 150 advantageously improves engine performance under a variety of operating conditions. With reference now to FIG. 5, the idle speed control 150 will be described in greater detail. As illustrated therein, an incoming bypass passage 152 draws a secondary supply of air from the plenum chamber 100. The passage 152 extends to an idle speed controller or ISC 154. More specifically, the air flow flowing through the incoming bypass passage 152 is merged with a flow of ventilation vapor coming through a ventilation duct 156 that originates within the vapor separation tank 76. The vent duct 156 provides a vent for gases building up within the vapor separation tanks 76. The ventilation duct 156 merges with the incoming bypass passage 152 and the combined gas and air flow passes through a merged flow conduit 158 to the ISC 154. The flow through the merged flow conduit 158 is controlled by the ISC in a manner which will be described in further detail below. A split pair of outgoing conduits 160 extend from the ISC 154 into the air flow downstream of the throttle valves 106 in the intake manifold 110.

With reference now to FIGS. 6–9, four different control strategies are illustrated therein. Each of the control strategies preferably is used for a different operating condition of the engine 28. Of course, the control strategies can be used for other types of engine operation if desired with modification of the various inputs and mapping strategies utilized.

Figure 6:
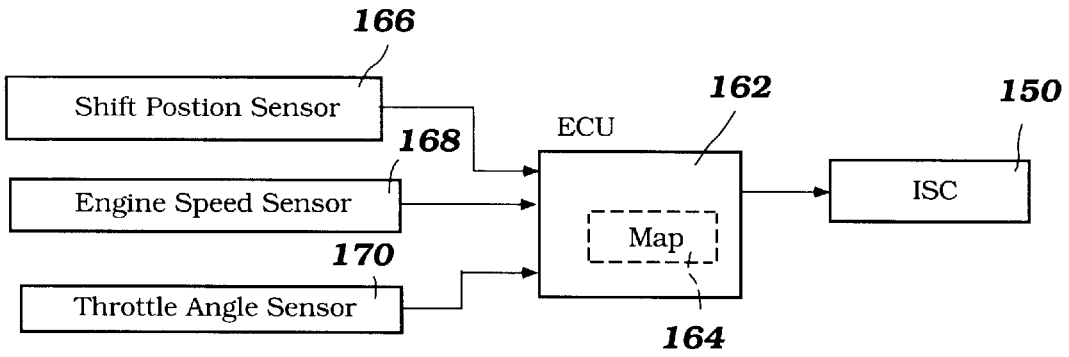
FIG. 6 schematically illustrates a speed control for use during idling operation of the engine.

With reference now to FIG. 6, a control system layout used for operating the engine during idling is illustrated therein. Idling involves operation of the engine 28 at a slow speed. During such operation, the engine may run rough and hunt for a proper operating condition. Accordingly, one aspect of the present invention provides a cylinder power equalization technique.

As illustrated, the control features an ECU or other processing unit 162. The ECU desirably contains a map 164 that reflects various inputs and an output. More specifically, the map 164 controls an output or allows the ECU 162 to control an output to the idle speed control 150. In the illustrated arrangement, during idling, the ECU polls output signals provided by a shift position sensor 166, an engine speed sensor 168 and a throttle angle sensor 170. These sensors 166, 168, 170 can be arranged and configured in any suitable manner and can include sensors positioned to indicate the positioning of the transmission, the speed of the flywheel or other indicator of engine speed and the positioning of the throttle. As the particular configuration of these sensors is not necessary for an understanding of the present invention, the sensors will not be further described.

The outputs, however, indicate to the ECU that the engine is in idle operation mode. For instance, the shift position sensor 166 can indicate that the transmission is in neutral. The engine speed sensor 168 can indicate a state of low speed operation and the throttle angle sensor 170 can reflect a state of non-acceleration. Accordingly, the ISC is instructed to control the flow of air through the bypass passage 158. Thus, the throttle valves 106 are substantially closed and bypass air is drawn through the bypass passage 158 through the control 154. The ISC 150 can control the timing and volume of flow through the outgoing conducts 160 such that the flow is increased or deceased to equalize performance of the individual cylinders.

As is known, the bypass control 150 can involve a stepper motor that moves a pinhole which opens and closes the air passage. In addition, the control 150 can actuate a bypass solenoid valve which is a duty cycle control valve that controls air flow bypassing the throttle. Alternatively, the control can incorporate a PM reversible motor that uses a pinhole or rotary valve when the motor polarity is reversed. Furthermore, an auxiliary air device can also be operated by the control 150 which involves a valve that is controlled by electrically heated bimetallic spring that is used to control cold engine past idle. An air metering screw can be used to control hot idle. Generally, these are not controlled by the ISC, but in some arrangements, these spring biased devices can be used.

Figure 7:
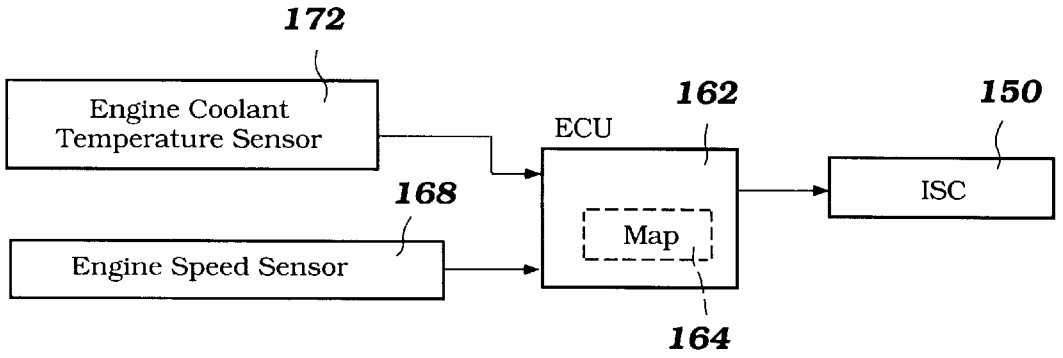
FIG. 7 schematically illustrates an engine speed control used during engine warm-up.

With reference now to FIG. 7, a warm-up control is illustrated therein. As illustrated, the ECU 162 again contains the map 164. The output from the ECU based upon the map 164 is used to control the ISC 150. The ECU in the warm-up phase polls an engine coolant temperature sensor 172 and an engine speed sensor 168. As will be recognized, the engine coolant temperature sensor 172 will emit a signal that is indicative of a cold engine operating condition. In addition, the engine speed sensor will indicate whether or not the engine is in the warm-up mode. Thus, the outputs from the sensors 168, 172 indicate to the ECU that the engine is in a warm-up condition. The ECU 162 consults the map 164 and outputs a respective value to the ISC 150. For example, the ISC may increase the flow of air through the bypass passage 158 until the engine has reached a proper operating temperature.

Figure 8:
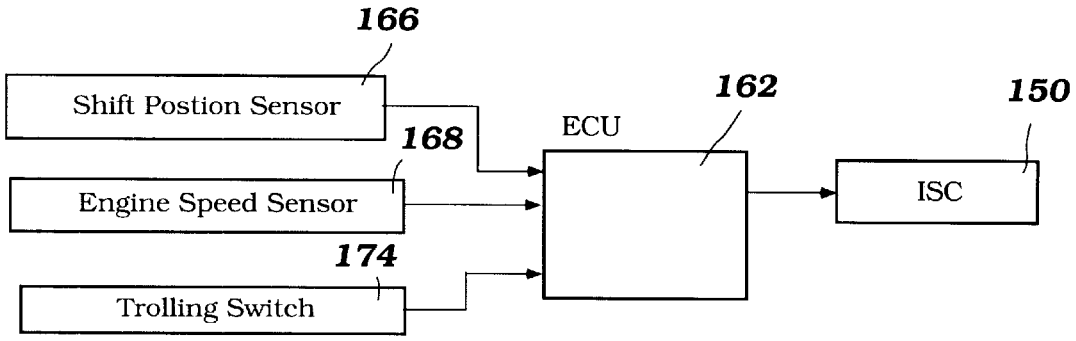
FIG. 8 schematically illustrates an engine control used during trolling operation of the engine.

With reference now to FIG. 8, a control strategy for operating the engine 28 in a trolling mode is illustrated therein. As is known, the engine operates at a slower speed during trolling than it does during idle. Accordingly, rough engine operation and hunting tends to be more prevalent during trolling. Thus, the present invention can be used to stabilize engine performance during trolling in some applications.

The trolling mode can be initiated using a trolling mechanism. The mechanism can either mechanically or electrically adjust the engine speed below the idle speed. For example, in one mode, a trolling initiation button communicates with the ECU. When actuated, the ECU controls the engine, including the ISC 150, to run at a speed slower than idle.

In the trolling mode, the ECU 162 controls the ISC 150 which in turn controls the rate of air flow through the bypass passage 158. In this arrangement, the ECU polls a shift position sensor 166, an speed sensor 168 and a trolling switch 174. The shift position sensor indicates that the transmission is in a drive position and the engine speed sensor indicates changes in engine speed. As the trolling switch is selected, the ECU recognizes that the engine should be operating in a trolling mode. In this mode, the ECU instructs the ISC to control the flow through the bypass passage 158 accordingly to variations in engine speed. Thus, the ECU is again instructing the ISC 150 based on the input levels received from the shift position sensor 166, the engine speed sensor 168, and the trolling switch 174. Preferably, the ISC can increase or decrease flow to change the richness or leanness of the air fuel charge such that engine operation can be improved. For instance, the power of a particular cylinder can be varied to equalize the cylinders in some applications.

Figure 9:
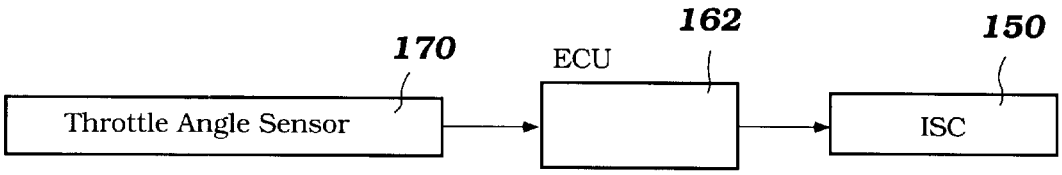
FIG. 9 schematically illustrates an engine speed control used during normal operation of the engine.

With reference now to FIG. 9, an engine control strategy is illustrated in which the engine is operating under normal operating conditions and rapidly accelerating. In this arrangement, the ECU 162 instructs the ISC 150 to control the valve which limits the flow through the bypass passage 158. More specifically, the throttle angle sensor 170 provides an output to the ECU that indicates the engine is in a normal operational mode. More specifically, the throttle angle sensor 170 outputs an output to the ECU 162 when the throttle angle changes rapidly indicating a rapid state of acceleration. During such a rapid state of acceleration, increased air supply can benefit the engine and help advance the rate of acceleration by the engine. Thus, the throttle angle sensor 170 can emit a signal indicative of a rapid acceleration period. The ECU 162, upon receiving such a signal, can direct the ISC 150 to open the path of flow through the sensor 154 such that air can flow through the bypass passage 158 into the intake manifold 110, thereby adding to the amounts of air and fuel flowing through the intake pipes 102 past the throttle valves 106. Accordingly, this helps to improve the responsiveness of the outboard motor 20 to the demand for rapid acceleration under normal operating conditions.

Figure 10:
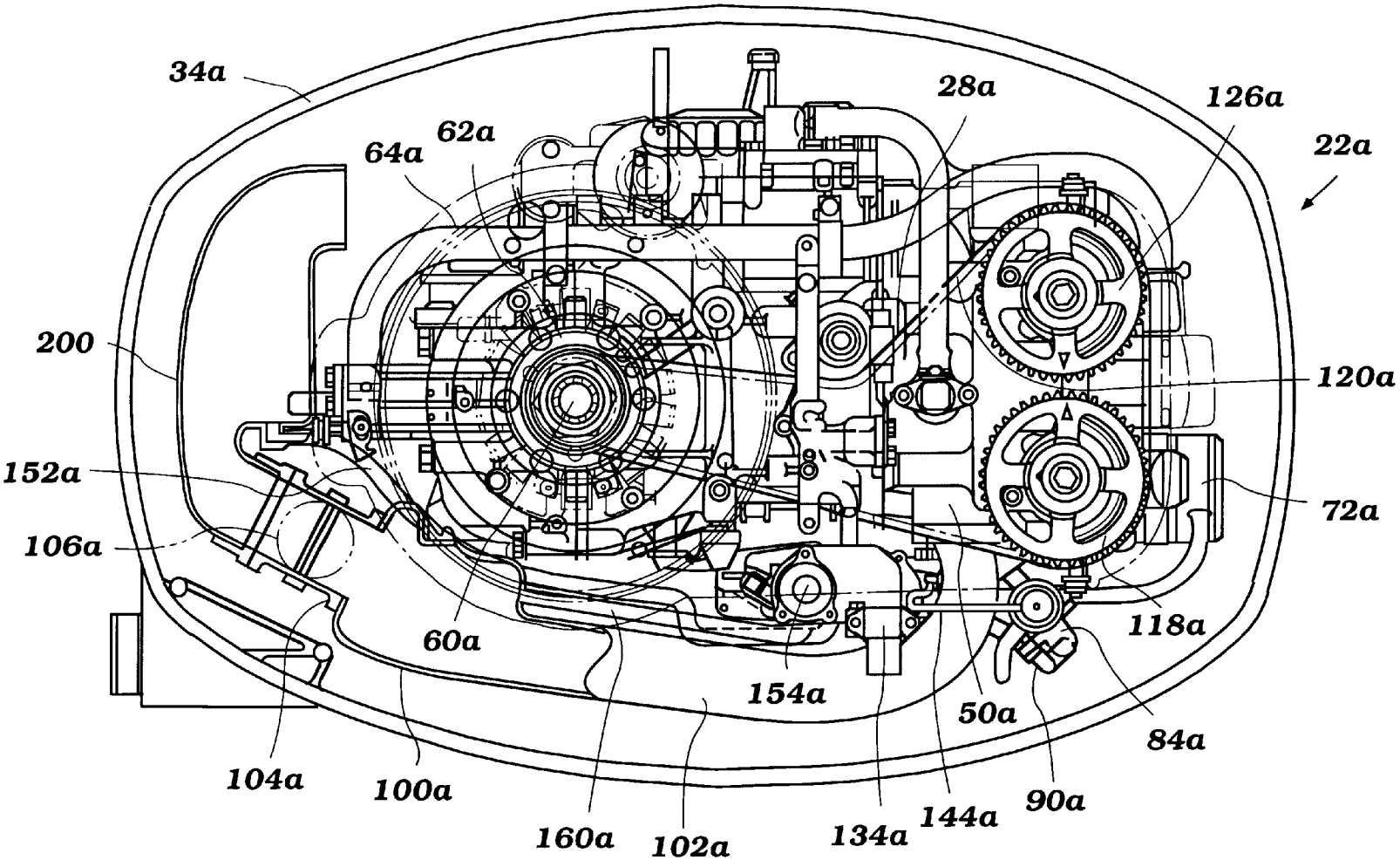
FIG. 10 is a top plan wire frame view of another outboard motor configured and arranged in accordance with certain features, aspects and advantages of the present invention.
Figure 11:
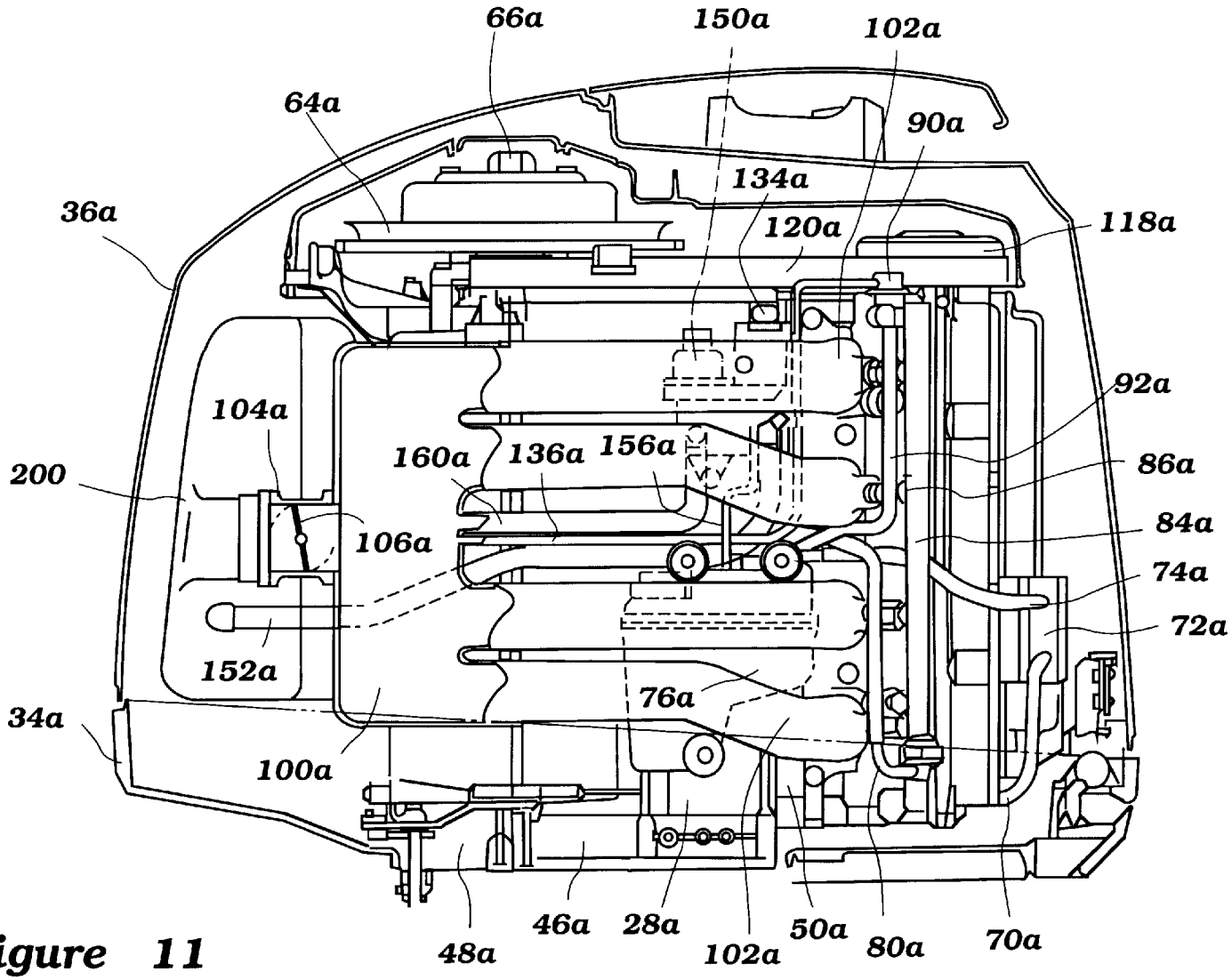
FIG. 11 is a partial side elevation wire frame view of the engine of the outboard motor of FIG. 10.
Figure 12:
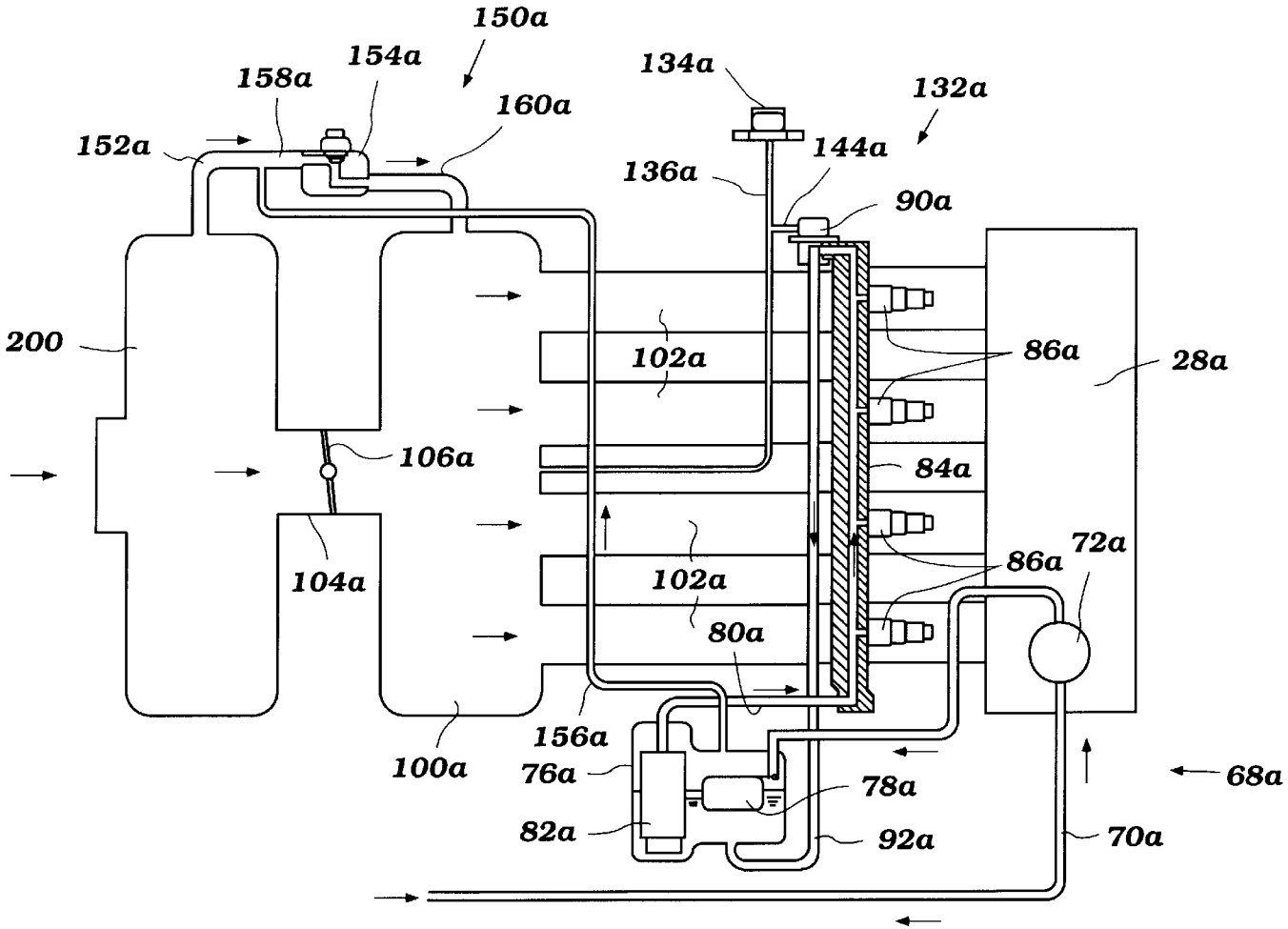
FIG. 12 is a schematic illustration of a fuel supply system and air induction system for the engine of the outboard motor of FIG. 10.

With reference now to FIGS. 10–12, an additional arrangement of an outboard motor having certain features, aspects and advantages in accordance with the present invention is illustrated therein. While the illustrated outboard motor of FIGS. 10–12 is very similar to the arrangement illustrated in FIGS. 1–5, some variations exist between the two arrangements. Accordingly, where like elements can be found from one arrangement to the other, like reference numerals have been used indicating such with the understanding that the above description of like elements applies equally to the embodiment illustrated in FIGS. 10–12, unless indicated otherwise. The suffix "a" has been added to the reference numerals in the embodiment illustrated in FIGS. 10–12. In addition, the elements illustrated in FIGS. 10–12 that are not represented in FIGS. 1–5 will be identified by non-suffixed reference numerals. Additionally, further description of the components indicated by the suffix letter "a" should not be necessary except to distinguish between the two arrangements.

With reference now to FIG. 10, the induction system of the second illustrated arrangement will be described in greater detail. In this arrangement, the plenum chamber 100*a* has been moved around to the side of the engine 28 and positioned further forward in the illustrated arrangement. Downstream of the plenum chamber, the plenum chamber is connected to the intake pipe 102*a*. The intake pipe 102*a* is in direct communication with the cylinder head 50*a*. In other words, the intake pipe 102*a* extends through to the cylinder head 50*a* rather than having an intake manifold or valve body interposed therebetween. The balance of the intake system downstream of the connection to the cylinder head 50*a* (i.e., intake valves and operating camshaft mechanisms) is substantially the same as that described above. Accordingly, further description is deemed unnecessary.

Upstream of the illustrated plenum chamber 100*a* differs from that of the arrangement from FIGS. 1–5. In particular, the throttle valve body number 104*a* has been positioned upstream of the plenum chamber 100*a* rather than downstream of the plenum chamber 100*a*. In this position, the throttle valve body 104*a* is interposed between the plenum chamber 100*a* and a silencer 200.

The silencer draws air from within the engine compartment defined by the cowling of the power head 22*a*. The throttle valve body member 104*a* also contains a throttle valve 106*a* which is configured and arranged in accordance with that described above. It should be pointed out, however, that a single throttle valve 106*a* is used in the illustrated arrangement of FIGS. 10–12. Accordingly, the passage through the throttle body 104*a* comprises a single passage between two single components in FIGS. 10–12 rather than four passages through four individual components such as that described above. Of course, either arrangement is suitable but each offers distinct advantages over the other.

With reference now to FIG. 12, differences in the induction air pressure detection system 132*a* and the idle speed control system 150*a* will be further described. Generally, the structure described with respect to FIG. 12 is greatly simplified over the structure described with respect to FIG. 5. In particular, the induction air pressure detection system 132*a* uses only one pipe 136*a* which communicates with the plenum chamber 100*a*. Of course, multiple pipes can be used as described above.

The plenum chamber 100*a* supplies the intake air to the intake pipes 102*a*. However, the air supply is limited through the throttle body 104*a* by use of the throttle valve 106*a*. Accordingly, the pressure within the plenum chamber 100*a* is a fairly good proxy for the pressure experience within each of the intake pipes 102*a*. Thus, the sensor 134*a* receives a reading of the pressure variations within the plenum chamber 100*a* through the pipe 136*a*.

In addition, as described above, a connecting conduit 144*a* connects the fuel pressure regulator 90*a* to the air induction pressure detection system 132*a*. This allows the pressure regulator 90*a* to be more responsive to changes within the pressure of the induction air system. Thus, the fuel injected by the fuel injectors 86*a* can be controlled partly in response to pressure variations within the induction system by changing the pressure within the fuel rail 84*a*.

With continued reference to FIG. 12, the vent duct 156*a* also extends from the vapor separation tank 76*a* to a bypass conduit 158*a*. The bypass conduit 158*a* is in communication with the silencer 200 through the incoming bypass passage 152*a*. The bypass passage 158*a* is also in communication with the ISC 154*a*. The ISC, as described above, controls the flow through the bypass passage 158*a* into the plenum chamber in the illustrated arrangement of FIG. 12. This flow is passed through an outgoing conduit 160*a*.

By controlling the passage into the conduit 160*a* and into the plenum chamber 100*a*, the ISC 154*a* controls the flow of bypass air independently of the positioning of the throttle valve 106*a*. Any of the control routines described above with respect to FIGS. 6–9 can be used in the arrangement of FIGS. 10–12. Accordingly, the throttle valve controls a main supply of air between the silencer 200 and the plenum chamber 100*a* in the arrangement illustrated in FIG. 12; however, the bypass air supply can pass through the bypass passage 158*a* and into the outgoing conduit 160*a* under the control of the ISC 154*a*. Thus, the air supply through the bypass passages can be increased in response to any number of situations. For instance, the flow rate through the bypass passage can be increased during idling, during warm-up, during trolling, and during high speed acceleration of the engine.

Although this invention has been described in terms of certain preferred embodiments, other embodiments apparent to those of ordinary skill in the art are also within the scope of the present invention. In addition, not all features, aspects or advantages of the present invention are necessarily required to practice certain other portions of the present invention, and various aspects of the described embodiments can be combined together. Accordingly, the scope of the present invention is intended to be defined only by the claims that follow.

What is claimed is:

1. An engine comprising a plurality of cylinders with corresponding combustion chambers, an induction system and a fuel supply system that are in fluid communication with the combustion chambers, the induction system comprising a plenum chamber, a plurality of intake conduits that correspond to the combustion chambers, each intake conduit being in fluid communication with the plenum chamber and with the corresponding combustion chamber, at least one throttle device arranged to regulate air flow into at least one of the combustion chambers, a bypass passage defining an auxiliary flow path in the induction system around the throttle device, a flow control member disposed in the bypass passage, the fuel supply system comprising a fuel supply, a supply conduit connecting the fuel supply to a vapor separation tank, at least one pump being positioned along the supply conduit, a plurality of fuel injectors being in fluid communication with the vapor separation tank, and a vent passage extending between the vapor separation tank and a portion of the bypass passage positioned upstream of the flow control member.

2. An engine as in claim 1 additionally comprising a plurality of throttle devices, each throttle device being positioned between at least one of the intake conduits and the plenum chamber, each throttle device including a throttle valve for regulating a flow of air through the throttle body, and the bypass passage extending from the plenum chamber to a portion of the induction system downstream from the throttle valve.

3. An engine as in claim 2, wherein one throttle device is positioned in each of the intake conduits such that the plurality of throttle devices and the plurality of intake conduits correspond in number.

4. An engine as in claim 3, wherein the bypass passage extends between the plenum chamber and each of the intake conduit.

5. An engine as in claim 4, wherein the bypass passage includes a branch that extends to each of the intake conduits.

6. An engine as in claim 3 additionally comprising an air intake chamber, the throttle device being arranged between the intake chamber and the plenum chamber with each intake conduit being connected to the plenum chamber, and the bypass passage extending between the air intake chamber and the plenum chamber.

7. An engine as in claim 1, wherein the flow control member is an idle speed control unit that adjusts the flow volume during engine operation in an idle state, and the engine additionally comprises an electronic controller that controls the flow control member.

8. An engine as in claim 1 additionally comprising an electronic controller being connected to and controlling the operation of the flow control member, the electronic controller and the flow control member being configured to allow an increased flow volume to pass through the bypass passage until the engine has achieved an engine operating temperature above a predetermined operating temperature.

9. An engine as in claim 8 additionally comprising a temperature sensor arrange to sense a temperature of coolant used to cool the engine, the temperature sensor being connected to the electronic controller so as to communicate a signal to the electronic controller that is indicative of the coolant temperature.

10. An engine as in claim 1 additionally comprising an electronic controller being connected to and controlling the operation of the flow control member, the electronic controller and the flow control member being configured to allow an increased flow volume to pass through the bypass passage when the engine is operated in a trolling state.

11. An engine as in claim 10 additionally comprising a trolling initiation mechanism.

12. An engine as in claim 1 additionally comprising an electronic controller being connected to and controlling the operation of the flow control member, the electronic controller and the flow control member being configured to allow an increased flow volume to pass through the bypass passage when the engine is in a period of rapid acceleration.

13. An engine as in claim 12 additionally comprising a throttle sensor arrange to sense a position of the throttle device, the throttle sensor being connected to the electronic controller so as to communicate a signal to the electronic controller that is indicative of the opening degree of the throttle device, and the electronic controller being configured to determine when the engine has begun a period of rapid acceleration using such signal.

14. An engine as in claim 1 additionally comprising an electronic controller being connected to and controlling the operation of the flow control member, the electronic controller and the flow control member being configured to adjust the flow volume through the bypass passage in response to movements of the throttle device.

15. An engine as in claim 1, wherein the cylinders are formed in a cylinder block and the vapor separation tank is at least partially positioned between the cylinder block and at least one of the intake conduits.

16. An engine as in claim 1, wherein the cylinders are formed in a cylinder block and the flow control member is at least partially positioned between the cylinder block and at least one of the intake conduits.

17. An engine as in claim 1 additionally comprising a balance passage extending between each of the intake conduits.

18. An engine as in claim 17, wherein the balance passage communicates with each of the intake conduits at a point downstream of a point at which the bypass passage communicates with the intake conduits.

19. An engine comprising a plurality of cylinders with corresponding combustion chambers, an induction system and a fuel supply system that are in fluid communication with the combustion chambers, the induction system comprising a plenum chamber, a plurality of intake conduits that correspond to the combustion chambers, each intake conduit being in fluid communication with the plenum chamber and with the corresponding combustion chamber, at least one throttle device arranged to regulate air flow into at least one of the combustion chamber, a bypass passage defining an auxiliary flow path in the induction system around the throttle device, and flow control means for selectively regulating flow through the bypass passage depending upon an engine operating condition, the fuel supply system comprising a fuel supply, a supply conduit connecting the fuel supply to a vapor separation tank, at least one pump being positioned along the supply conduit, a plurality of fuel injectors being in fluid communication with the vapor separation tank, and a vent passage extending between the vapor separation tank and a portion of the bypass passage positioned upstream of the flow control means.

20. An engine as in claim 19, wherein the at least one throttle device is arranged between a silencer and the plenum chamber.

21. An engine as in claim 20, wherein the bypass passage extends between the silencer and the plenum chamber.

22. An engine as in claim 19, wherein the bypass passage extends between the plenum chamber and each of the intake conduit.

23. An engine as in claim 22, wherein the bypass passage includes a branch that extends to each of the intake conduits.

24. An engine as in claim 19, wherein the flow control means comprises an idle speed control unit that adjusts the flow volume during engine operation in an idle state and an electronic controller that controls the flow control member.

25. An engine as in claim 19, wherein the flow control means is configured to allow an increased flow volume to pass through the bypass passage until the engine has achieved an engine operating temperature above a predetermined operating temperature.

26. An engine as in claim 25 additionally comprising a temperature sensor arrange to sense a temperature of coolant used to cool the engine, the flow control means being configured for actuation based in part upon output from the temperature sensor.

27. An engine as in claim 19, wherein the flow control means is configured to allow an increased flow volume to pass through the bypass passage when the engine is operated in a trolling state.

28. An engine as in claim 19 additionally comprising a trolling initiation mechanism, the flow control means being configured for actuation based in part upon output from the trolling initiation mechanism.

29. An engine as in claim 19, wherein the flow control means is configured to allow an increased flow volume to pass through the bypass passage when the engine is in a period of rapid acceleration.

30. An engine as in claim 29 additionally comprising a throttle sensor arrange to sense a position of the throttle device, the throttle sensor being configured to output a signal that is indicative of the opening degree of the throttle device, and the flow control means being configured to determine when the engine has begun a period of rapid acceleration using such output.

31. An engine as in claim 19, wherein the flow control means is configured to adjust the flow volume through the bypass passage in response to movements of the throttle device.

32. An engine as in claim 19, wherein the cylinders are formed in a cylinder block and the vapor separation tank is at least partially positioned between the cylinder block and at least one of the intake conduits.

33. An engine as in claim 19, wherein the cylinders are formed in a cylinder block and the flow control member is at least partially positioned between the cylinder block and at least one of the intake conduits.

34. An engine as in claim 19 additionally comprising a balance passage extending between each of the intake conduits.

35. An engine as in claim 34, wherein the balance passage communicates with each of the intake conduits at a point downstream of a point at which the bypass passage communicates with the intake conduits.

36. An engine comprising an intake system and a fuel system, the intake system comprising an intake passage, a throttle valve disposed along the intake passage, a bypass passage communicating with the intake passage upstream of the throttle valve and downstream of the throttle valve, a flow regulator disposed along the bypass passage, the fuel system comprising a vapor separation tank, a vent conduit extending from the vapor separation tank to the bypass passage and the vent conduit communicating with the bypass passage upstream of the flow regulator.

* * * * *